US005520145A

United States Patent [19]

Nagai et al.

[11] Patent Number: 5,520,145

[45] Date of Patent: May 28, 1996

[54] VALVE TIMING CONTROLLER

[75] Inventors: Susumu Nagai; Nobuo Iida, both of Amagasaki, Japan

[73] Assignee: Osaka Fuji Kogyo Kabushiki Kaisha, Japan

[21] Appl. No.: 324,341

[22] Filed: Oct. 17, 1994

[30] Foreign Application Priority Data

Feb. 25, 1994 [JP] Japan ..... 6-028393

[51] Int. Cl.[6] ..... F01L 1/34

[52] U.S. Cl. ..... 123/90.17; 123/90.31

[58] Field of Search ..... 123/90.15, 90.17, 123/90.31, 90.12, 90.13; 74/568 R, 567; 464/2, 160

[56] References Cited

U.S. PATENT DOCUMENTS

| | | | |
|---|---|---|---|
| 4,858,572 | 8/1989 | Shirai et al. | 123/90.12 |
| 4,903,650 | 2/1990 | Ohlendorf et al. | 123/90.17 |
| 5,107,804 | 4/1992 | Becker et al. | 123/90.17 |
| 5,172,659 | 12/1992 | Butterfield et al. | 123/90.17 |
| 5,205,249 | 4/1993 | Markley et al. | 123/90.17 |
| 5,207,192 | 5/1993 | Smith | 123/90.17 |
| 5,218,935 | 6/1993 | Quinn, Jr. et al. | 123/90.17 |
| 5,263,443 | 11/1993 | Schlechter et al. | 123/90.17 |
| 5,291,860 | 3/1994 | Quinn, Jr. | 123/90.17 |
| 5,361,735 | 11/1994 | Butterfield et al. | 123/90.17 |
| 5,367,992 | 11/1994 | Butterfield et al. | 123/90.17 |

FOREIGN PATENT DOCUMENTS

| | | |
|---|---|---|
| 59-115413 | 7/1984 | Japan . |
| 533615 | 2/1993 | Japan . |

*Primary Examiner*—Weilun Lo

*Attorney, Agent, or Firm*—Ostrolenk, Faber, Gerb & Soffen

[57] ABSTRACT

A valve timing controller for varying the rotating phase of a cam shaft which drives a valve of an internal combustion engine. A pulley is disposed on the circumference of the cam shaft at an end to be freely rotatable. In the pulley, a first hydraulic chamber and a second hydraulic chamber are made, and these hydraulic chambers are separated in the circumferential direction of the pulley by a vane located on the circumference of the cam shaft. By controlling the pressures in the first and second hydraulic chambers, the vane is set selectively in a middle position, a valve timing retardation position which is an opposite position with respect to a pulley rotating direction and a valve timing advance position which is a farther forward position with respect to the pulley rotating direction. The cam shaft rotates with the movement of the vane.

3 Claims, 6 Drawing Sheets

VALVE TIMING CONTROLLER

BACKGROUND OF THE INVENTION

1. Field of the Invention

The present invention relates to a valve timing controller, and more particularly to a valve timing controller for varying open/close timing of a valve in an internal combustion engine depending on the driving state.

2. Description of Related Art

In the art of automobile, it is generally known, for example, from Japanese Patent Laid Open Publications 59-115413 and 5-33615 that open/close timing of an intake valve is varied (for valve timing advance and valve timing retardation) depending on the driving state, namely, the engine speed and the engine torque.

In such a conventional valve timing controller, a rotating force is transmitted from a crank shaft to a cam shaft for driving an intake valve via a helical gear, and a hydraulic piston is provided on the cam shaft at an end. The hydraulic piston has hydraulic chambers at both sides, and hydraulic oil is supplied to selectively either of the hydraulic chambers. The piston moves the helical gear in a direction along the axis of the cam shaft, and the engaging position of the helical gear is changed along the array of teeth. Thereby, the rotating phase of the cam shaft with respect to the crank shaft is advanced or retarded.

However, because two hydraulic chambers are provided in the axial direction of the cam shaft and because the piston and the helical gear are moved in the axial direction, the conventional valve timing controller requires a large space in the axial direction and becomes large and heavy. Further, since the rotating phase is varied by the movement of the helical gear, the responsiveness in changing the rotating phase is a problem.

SUMMARY OF THE INVENTION

An object of the present invention is to provide a valve timing controller which is compact and light and has a good responsiveness.

In order to attain the object, a valve timing controller according to the present invention comprises: a pulley which is disposed at an end of a earn shaft to be freely rotatable; a vane located on the cam shaft at the end; a hydraulic chamber which is made in the pulley and is parted in the circumferential direction of the pulley by the vane; and hydraulic means for controlling the pressure in the hydraulic chamber. A rotating force is transmitted from a crank shaft to the pulley via a timing belt.

In the structure, the pulley and the earn shaft are connected by the vane to rotate together, and the earn shaft receives the rotating force transmitted via the timing belt and rotates with the pulley. In order to change the phase of the cam shaft for valve timing retardation, the vane is moved opposite with respect to the pulley rotating direction. On the other hand, in order to change the phase of the cam shaft for valve timing, the vane is moved to farther forward in the pulley rotating direction.

According to the present invention, a hydraulic chamber is made in the pulley, and inside the hydraulic chamber, the vane is moved in the circumferential direction to change the phase of the cam shaft. Compared with a conventional device wherein a helical gear is moved in the axial direction, the valve timing controller of the present invention has a simple structure and is small and light. Further, since the movement of the vane is smooth, only a small amount of hydraulic oil is necessary, and the responsiveness in changing the phase is good.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

The preferred embodiments of the present invention are described with reference to the accompanying drawings.

First Embodiment: FIGS. 1–5

Figure 1:
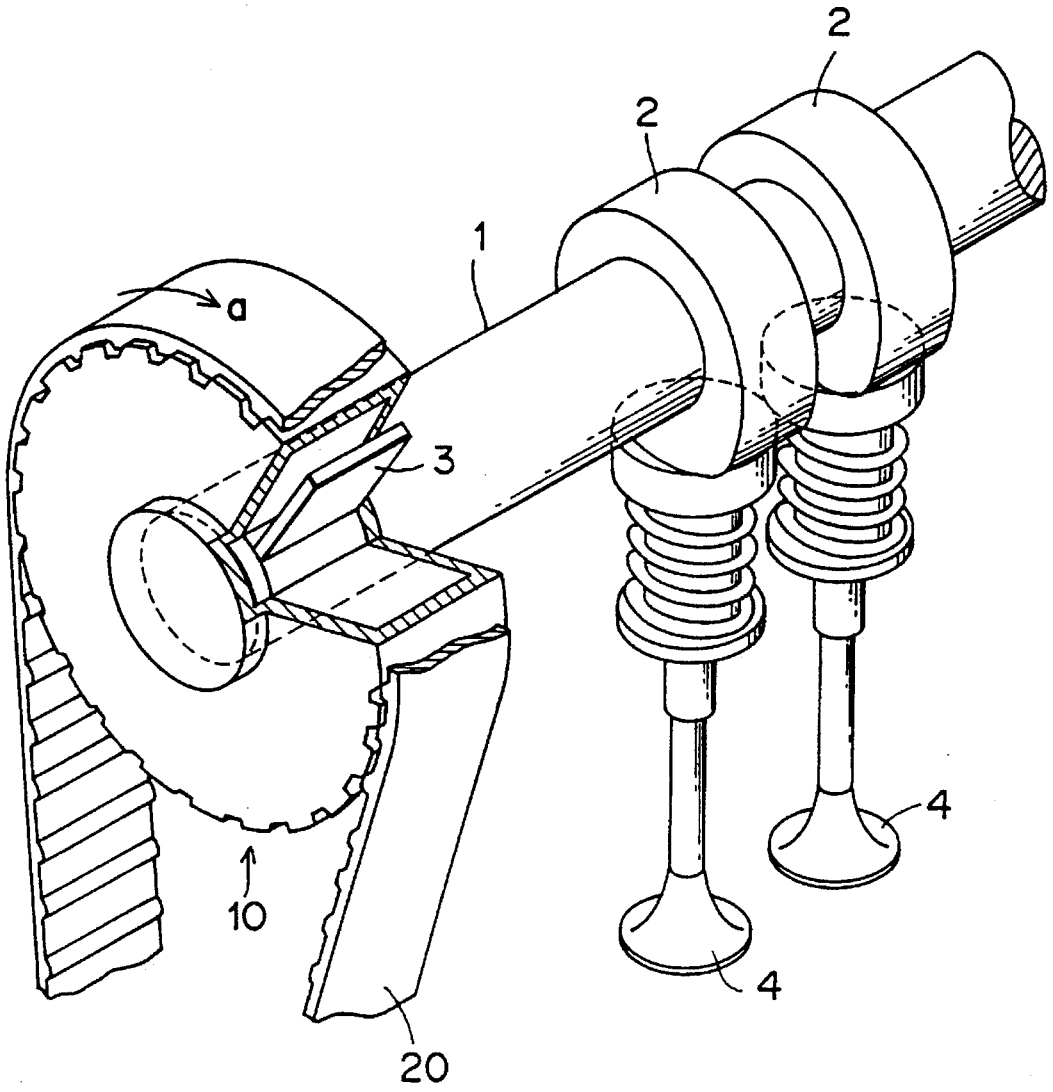
FIG. 1 is a perspective view of a valve timing controller which is a first embodiment of the present invention.

As shown in FIG. 1, a valve timing controller comprises a cam shaft 1, a pulley 10, a timing belt 20 and a hydraulic mechanism 30. The cam shaft 1 has, on the circumference, cams 2 for activating intake valves 4, and has a vane 3 at an end. The pulley 10 is composed of a first housing 11 which has teeth 12 engaging with the timing belt 20 and a second housing 13 (see FIG. 4). In the pulley 10, hydraulic chambers 15 and 16 which are separated by the vane 3 are made. The timing belt 20 is driven to rotate by a crank shaft (not shown), and thereby, the pulley 10 is rotated in a direction indicated with an arrow "a".

The hydraulic chambers 15 and 16 are separated from each other in the circumferential direction by the vane 3. Ports P1 and P3 are provided in the side of advance, and ports P2 and P4 are provided in the side of retardation. A slit-type port P5 is provided in the center, and a wedge opening 3*a* of the vane 3 is opposite to the port P5.

Figure 3:
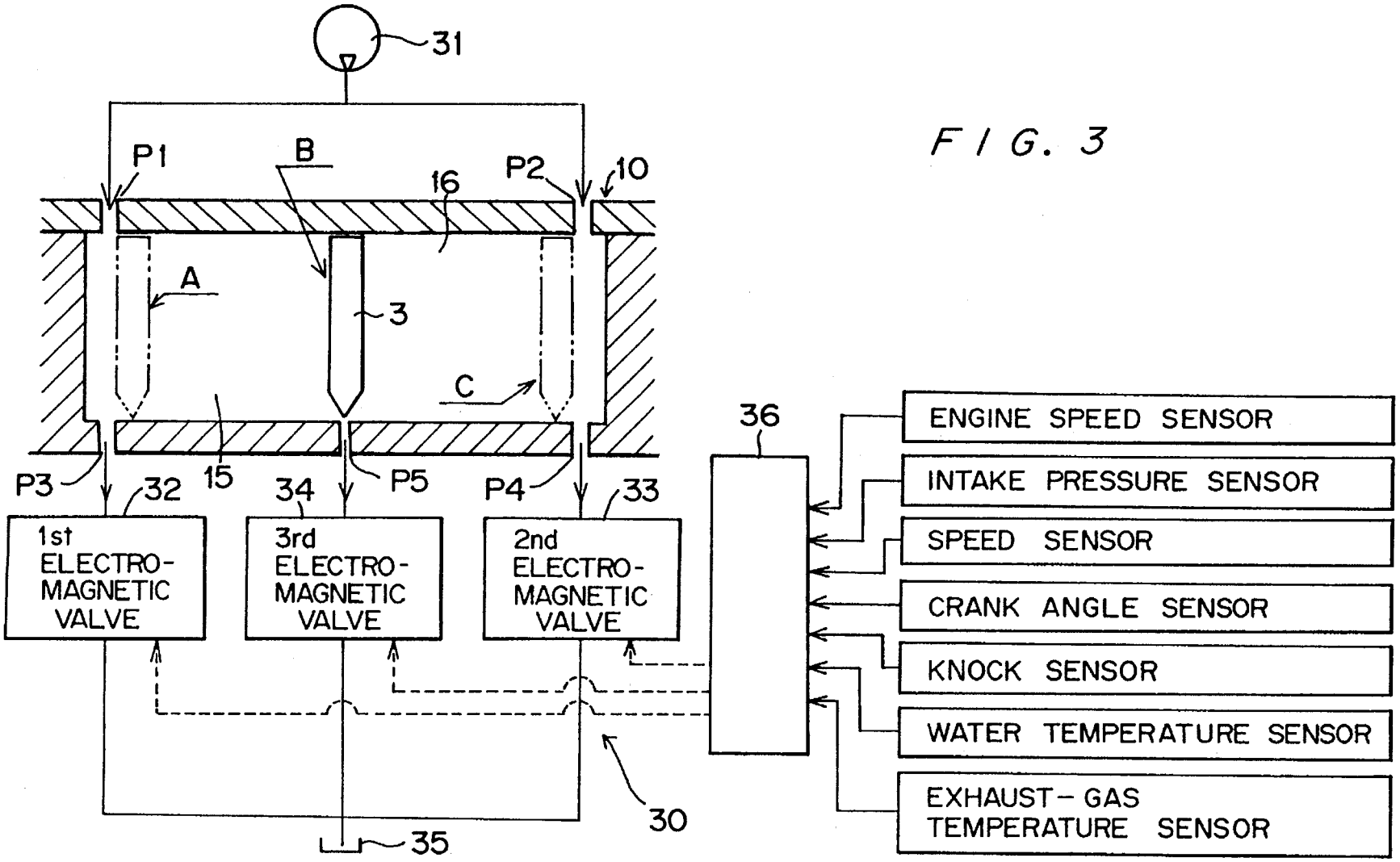
FIG. 3 is a sectional view of the valve timing controller taken along a line III—III in FIG. 2, showing a hydraulic mechanism and its control section.
Figure 4:
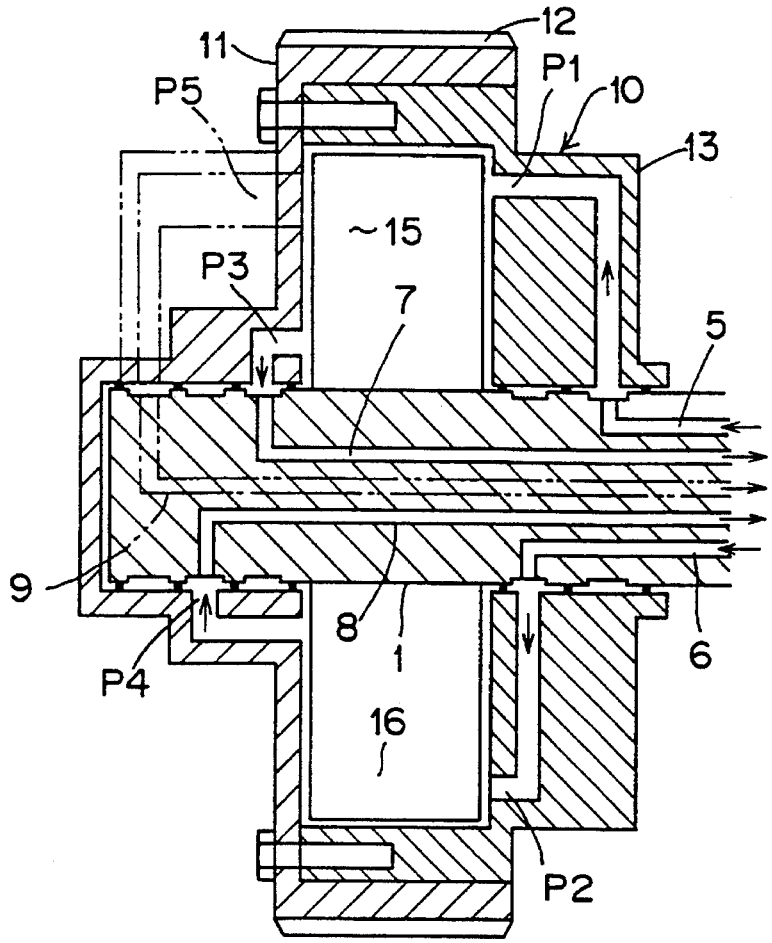
FIG. 4 is a sectional view of the valve timing controller showing a hydraulic passage.

FIG. 3 shows the hydraulic mechanism 30 and its control section, and FIG. 4 shows the hydraulic passage. The port P1 is connected with a hydraulic oil supply section 31 via a channel 5 made in the cam shaft 1. The port P2 is connected with the hydraulic oil supply section 31 via a channel 6. The port P3 is connected with a hydraulic oil exhaust section 35 via a channel 7 and a first electromagnetic valve 32. The port P4 is connected with the hydraulic oil exhaust section 35 via a channel 8 and a second electromagnetic valve 33. The port P5 is connected with the hydraulic oil exhaust section 35 via a channel 9 and a third electromagnetic valve 34. A hydraulic pump (not shown) is driven by a crank shaft.

The electromagnetic valves 32, 33 and 34 are turned on and off by order of a microcomputer 36. The microcomputer 36 receives data from sensors which detect the driving state, namely, an engine speed sensor, an intake pressure sensor, a speed sensor, a crank angle sensor, a knock sensor, a water temperature sensor, an exhaust temperature sensor, etc., and controls the running of engine in accordance with these data.

Now, the action of the valve timing controller of the first embodiment is described.

Figure 2:
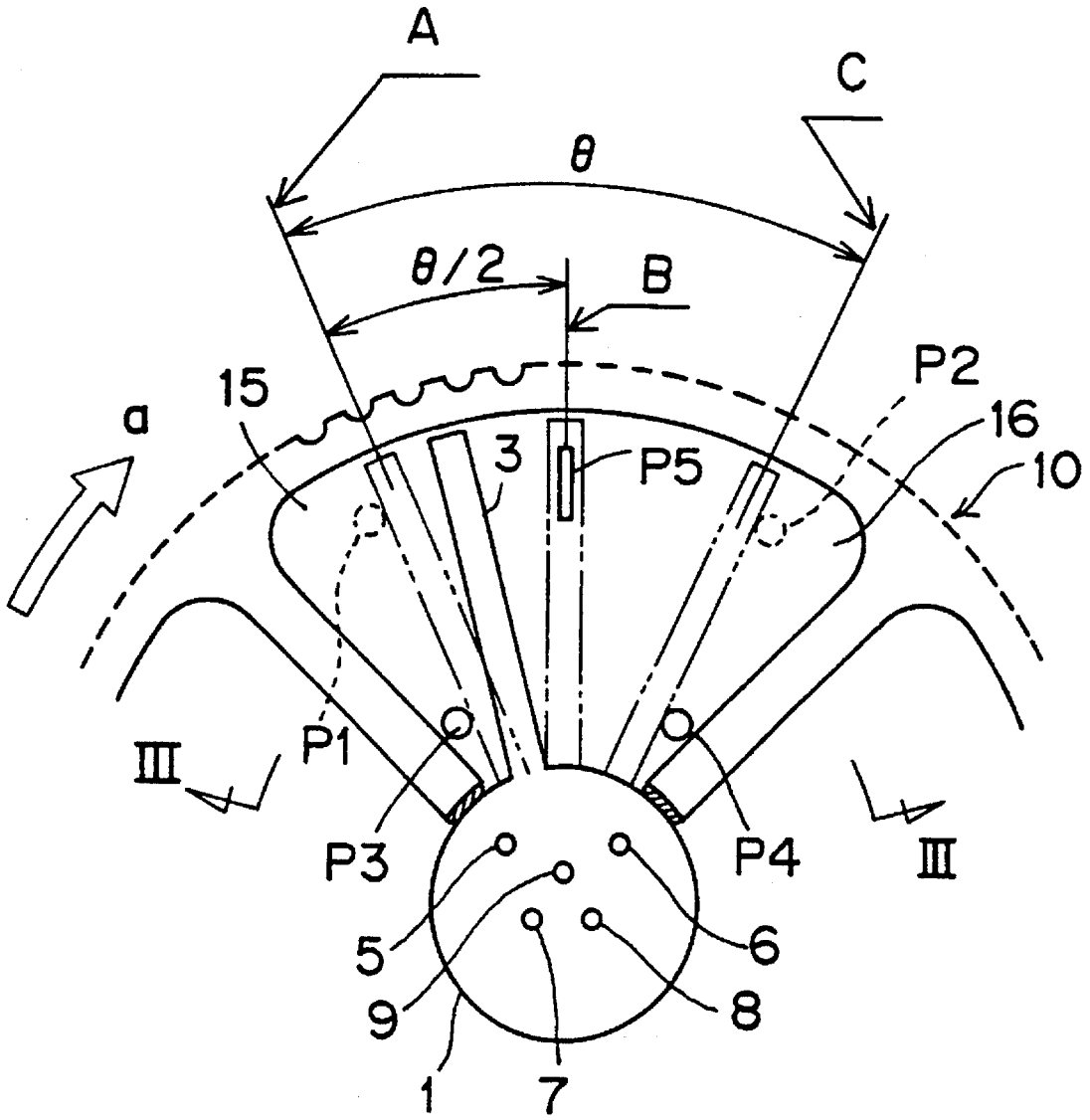
FIG. 2 is an illustration showing movement of a vane and locations of ports in the valve timing controller.

The vane 3 can be set in positions A, B and C shown in FIGS. 2 and 3. The position A is a valve operation retardation position for a low-speed and low-torque drive. The position B is for a normal-speed and normal-torque drive. The position C is a valve operation advance position for a high-speed and high-torque drive.

At the start of driving, the vane 3 is set in the position A. In this state, the first electromagnetic valve 32 is opened, and the second and third electromagnetic valves 33 and 34 are closed. The crank shaft is rotated with running of the engine, and thereby, the hydraulic pump is driven. Then, the pressure in the hydraulic chamber 16 becomes relatively high, and the vane 3 is fixed in the position A.

Figure 5:
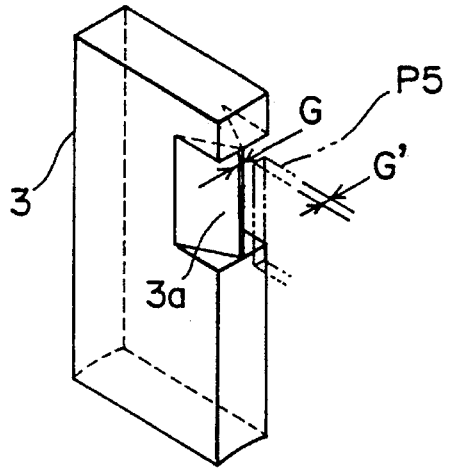
FIG. 5 is a perspective view of the vane of the valve timing controller.

When the driving becomes a normal state, the vane 3 is set in the position B where the vane 3 separates the hydraulic chambers 15 and 16. In the normal driving state, the first and second electromagnetic valves 32 and 33 are closed, and the third electromagnetic valve 34 is open. In this state, the hydraulic oil flows into the hydraulic chambers 15 and 16 via the ports P1 and P2 respectively and flows therefrom via the port P5. In order to balance the pressures in the hydraulic chambers 15 and 16, the vane 3 rotates in the pulley rotating direction a by θ/2 and comes to the position B. Accordingly, the cam shaft 1 rotates in the pulley rotating direction a by θ/2. If the port P5 has a small width and is located in an outer peripheral portion of the pulley 10, and if the opening 3*a* is a sharp wedge, only a small amount of oil stably flows out through the port P5, and shake of the vane 3 can be minimized. Preferably, as shown in FIG. 5, the thickness G of the edge of the wedge is slightly smaller than the width G' of the port P5.

When the driving comes to a high-speed and high-torque state, the second electromagnetic valve 33 becomes open, and the first and third electromagnetic valves 32 and 34 are closed. Thereby, the pressure in the hydraulic chamber 15 becomes relatively high, and the vane 3 further rotates in the pulley rotating direction a by θ/2 and comes to the position C. Accordingly, the cam shaft 1 rotates in the same direction by θ/2. On the other hand, when the driving comes to a low-speed and low-torque state, the first electromagnetic valve 32 becomes open, and the second and the third electromagnetic valves 33 and 34 are closed. Thereby, the pressure in the hydraulic chamber 16 become relatively high, and the vane 3 rotates in the opposite direction to the pulley rotating direction a and comes to the position A. Accordingly, the cam shaft 1 rotates in the same direction.

Figure 6:
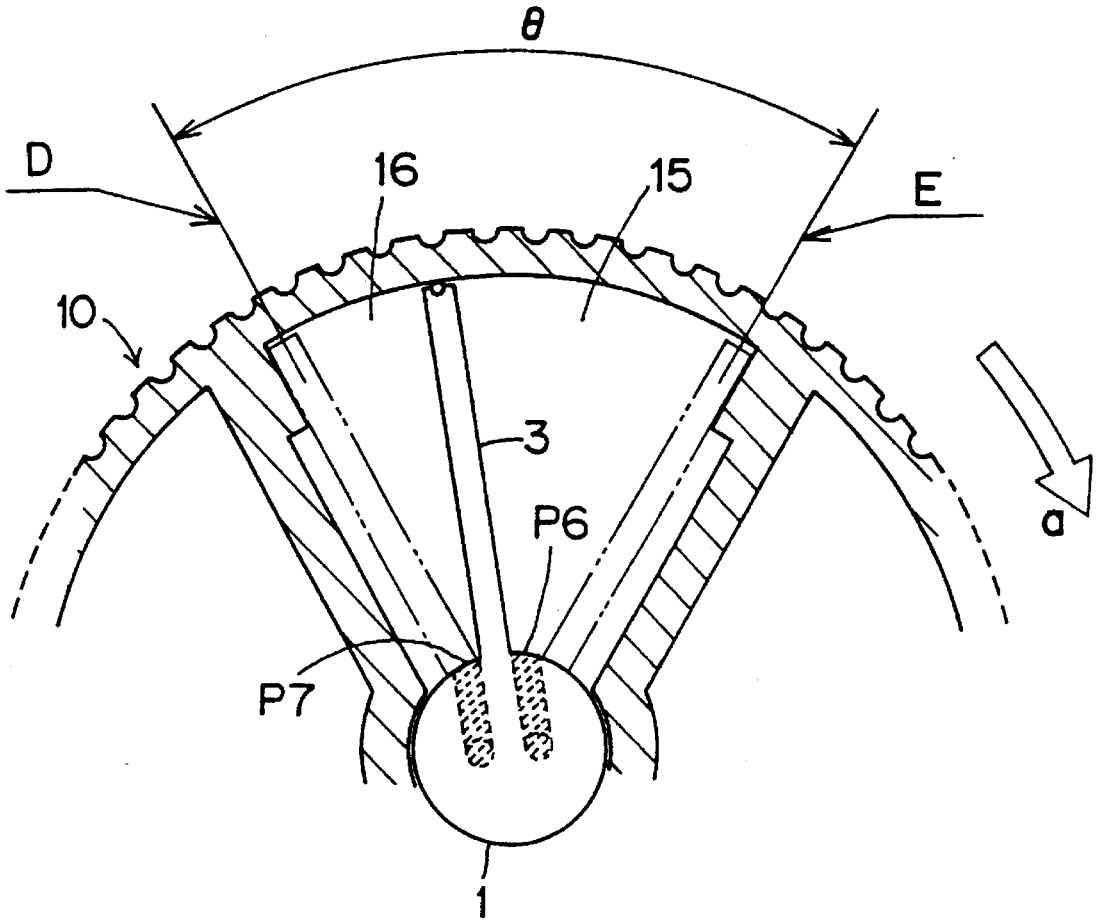
FIG. 6 is an illustration showing movement of a vane in a valve timing controller which is a second embodiment of the present invention.
Figure 7:
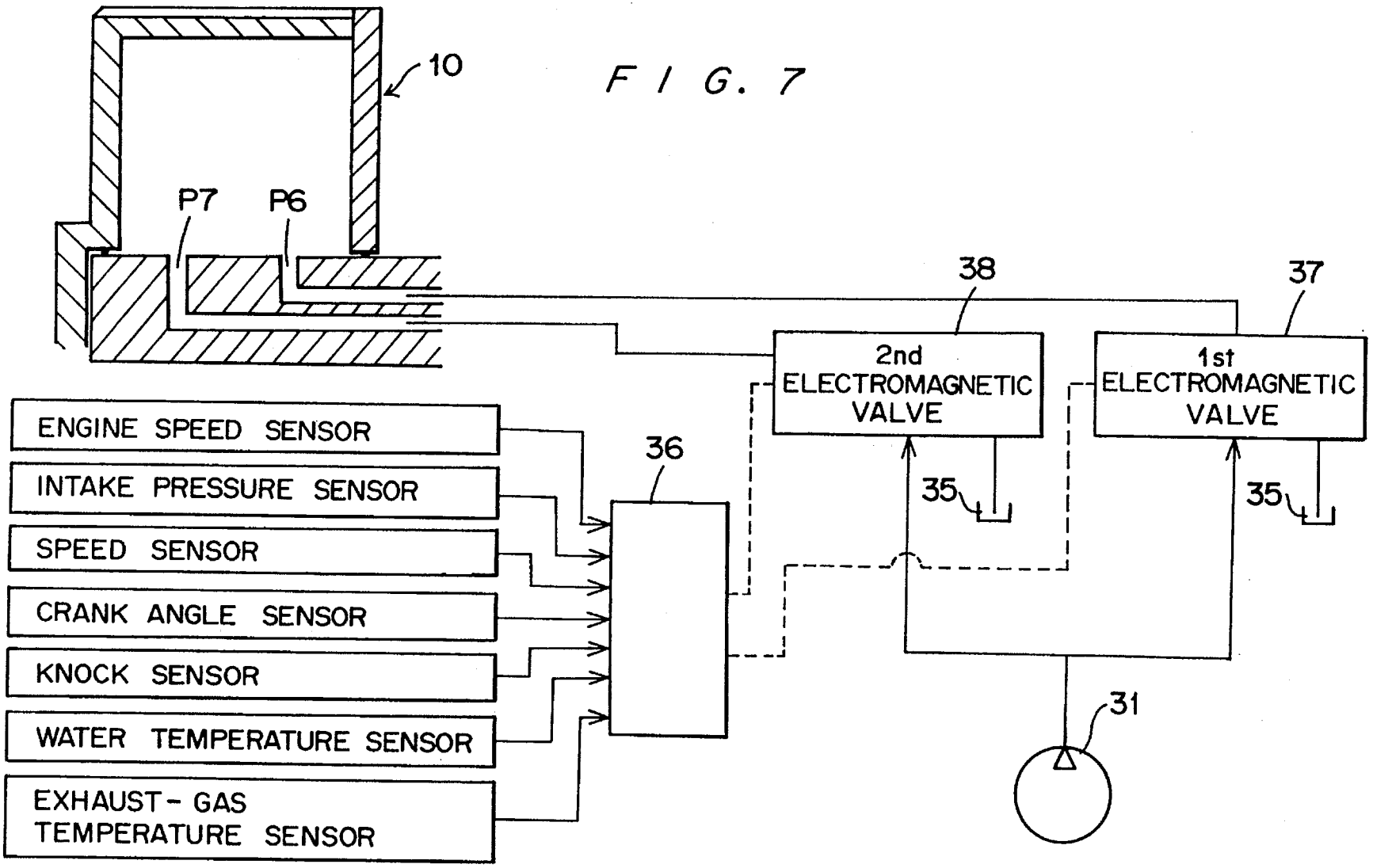
FIG. 7 is a sectional view of the valve timing controller of the second embodiment showing a hydraulic mechanism and its control section.

Second Embodiment: FIGS. 6–7

In the second embodiment, the vane 3 is set at any angle within a range of θ from a position D to a position E. The members of the second embodiment which are also used in the first embodiment are denoted by the same reference symbols as used in the first embodiment.

In the cam shaft 1, ports P6 and P7 are made. The port P6 communicates with the hydraulic chamber 15, and the port P7 communicates with the hydraulic chamber 16. The ports P6 and P7 are connected with the hydraulic oil supply section 31 and the hydraulic oil exhaust section 35 via a first electromagnetic valve 37 and a second electromagnetic valve 38 respectively. The first and second electromagnetic valves 37 and 38, as the electromagnetic valves 32, 33 and 34 in the first embodiment, are turned on and off by order of the microcomputer 36 which receives data from various sensors.

In the second embodiment, when the first electromagnetic valve 37 is turned on, hydraulic oil is supplied to the hydraulic chamber 15 through the port P6 and is exhausted from the hydraulic chamber 16 through the port P7. Thereby, the vane 3 and the cam shaft 1 rotates in the opposite direction to the pulley rotating direction a. When the vane 3 comes to the position D, the electromagnetic valves 37 and 38 are locked, and thus, the vane 3 is retained in a position for valve timing retardation. On the other hand, when the second electromagnetic valve 38 is turned on, the hydraulic oil is supplied to the hydraulic chamber 16 through the port P7 and is exhausted from the hydraulic chamber 15 through the port P6. Thereby, the vane 3 and the cam shaft 1 rotates in the pulley rotating direction "a." When the vane 3 comes to the position E, the electromagnetic valves 37 and 38 are locked, and thus, the vane 3 is retained in a position for valve timing advance.

If the electromagnetic valves 37 and 38 are locked in the course of rotation of the vane 3 toward the valve timing retardation position or the valve timing advance position, the pressures in the hydraulic chambers 15 and 16 are balanced at that time, and the vane 3 is stopped there. In this way, in the second embodiment, the vane 3 can be set in any position within a range of θ, and therefore the valve timing can be controlled minutely.

Although the present invention has been described connection with the preferred embodiments above, it is to be noted that various changes and modifications are possible to those who are skilled in the art. Such changes and modifications are to be understood as being within the scope of the present invention.

What is claimed is:

1. A valve timing controller for an internal combustion engine, the valve timing controller comprising:

a pulley disposed at an end of a cam shaft to be freely rotatable, the cam shaft driving a valve of the internal combustion engine;

a vane which is disposed on a circumference of the cam shaft;

a hydraulic chamber in the pulley, the hydraulic chamber being divided in a circumferential direction of the cam shaft by the vane; and hydraulic means for controlling pressure in the hydraulic chamber, the hydraulic means includes;

a first port which is open to the hydraulic chamber at an advance side with respect to a cam shaft rotating direction;

a second port which is open to the hydraulic chamber at a retarding side with respect to the cam shaft rotating direction;

a pump which supplies hydraulic oil to the first port and the second port;

a third port which is open to the hydraulic chamber at an advance side with respect to the cam shaft rotating direction;

a fourth port which is open to the hydraulic chamber at a retarding side with respect to the cam shaft rotating direction;

a fifth port which is open to the hydraulic chamber at a position between the third port and the fourth port; and a control member which opens and closes selectively one of the third, the fourth and, the fifth ports.

2. A valve timing controller for an internal combustion engine, the valve timing controller comprising:

a pulley disposed at an end of a cam shaft to be freely rotatable, the cam shaft driving a valve of the internal combustion engine;

a vane disposed on a circumference of the cam shaft, the vane having an edge, a portion of the vane being generally wedge shaped as it extends to the edge of the vane;

a hydraulic chamber in the pulley, the hydraulic chamber being divided in a circumferential direction of the cam shaft by the vane; and hydraulic means for controlling pressure in the hydraulic chamber, the hydraulic means includes:

a first port which is open to the hydraulic chamber at an advance side with respect to a cam shaft rotating direction;

a second port which is open to the hydraulic chamber at a retarding side with respect to the cam shaft rotating direction;

a pump which supplies hydraulic oil to the first port and the second port;

a third port which is open to the hydraulic chamber at an advance side with respect to the cam shaft rotating direction;

a fourth port which is open to the hydraulic chamber at a retarding side with respect to the cam shaft rotating direction;

a fifth port which is open to the hydraulic chamber at a position between the third port and the fourth port, and said fifth port capable of being positioned opposite the wedge shaped portion of the vane; and a control member which opens and closes selectively one of the third, the fourth and the fifth ports.

3. The valve timing controller according to claim 2, wherein the wedge shaped portion of the vane is formed by two converging walls which extend to the edge of the vane, the edge of the vane at the wedge shaped portion of the vane having a width that is slightly smaller than a width of the fifth port.

* * * * *